US010786047B2

(12) United States Patent
McGinnis et al.

(10) Patent No.: US 10,786,047 B2
(45) Date of Patent: Sep. 29, 2020

(54) FOOTWEAR SYSTEM

(71) Applicants: Diane K. McGinnis, Bensalem, PA (US); Benedict G. McGinnis, Bensalem, PA (US)

(72) Inventors: Diane K. McGinnis, Bensalem, PA (US); Benedict G. McGinnis, Bensalem, PA (US)

( * ) Notice: Subject to any disclaimer, the term of this patent is extended or adjusted under 35 U.S.C. 154(b) by 6 days.

(21) Appl. No.: 16/466,861

(22) PCT Filed: Nov. 7, 2017

(86) PCT No.: PCT/US2017/060267
§ 371 (c)(1),
(2) Date: Jun. 5, 2019

(87) PCT Pub. No.: WO2018/106376
PCT Pub. Date: Jun. 14, 2018

(65) Prior Publication Data

US 2019/0343236 A1 Nov. 14, 2019

Related U.S. Application Data

(60) Provisional application No. 62/430,032, filed on Dec. 5, 2016.

(51) Int. Cl.
*A43C 15/02* (2006.01)
*A43B 3/24* (2006.01)
(Continued)

(52) U.S. Cl.
CPC ..... *A43C 15/02* (2013.01); *A43B 3/101* (2013.01); *A43B 3/24* (2013.01); *A43B 13/22* (2013.01)

(58) Field of Classification Search
CPC ..... A43C 15/02; A43B 5/18; A43B 3/0026; A43B 3/24; A63C 13/00; A63C 13/001;
(Continued)

(56) References Cited

U.S. PATENT DOCUMENTS 2,097,249 A * 10/1937 Keene ..... A63C 13/005 36/122
2,431,748 A * 12/1947 Gershak ..... A43C 15/063 36/62

(Continued)

FOREIGN PATENT DOCUMENTS

FR 2976460 A1 12/2012

OTHER PUBLICATIONS

English Translation of Description of Foreign Patent Document FR2976460A1.
International Search Report dated Jan. 26, 2018.

*Primary Examiner* — Ted Kavanaugh
(74) *Attorney, Agent, or Firm* — Caesar Rivise, PC

(57) ABSTRACT

A beach shoe system including a beach shoe and a stabilizing member. The stabilizing member, when attached to the beach shoe, being below the beach shoe and being removably attached to the beach shoe. The stabilizing member includes a porous, substantially planar section underlying a sole of the beach shoe and extending transversely beyond peripheral sides of the beach shoe. The stabilizing member preferably includes a peripheral rim attached to the planar section and extending downwardly and upwardly therefrom.

13 Claims, 3 Drawing Sheets

(51) Int. Cl.
*A43B 3/10* (2006.01)
*A43B 13/22* (2006.01)

(58) Field of Classification Search
CPC ..... A63C 13/003; A63C 13/05; A63C 13/006; A63C 13/008; A63C 13/02
USPC ..... 36/122–125, 116
See application file for complete search history.

(56) References Cited

U.S. PATENT DOCUMENTS

| | | | | |
|---|---|---|---|---|
| 4,259,793 | A * | 4/1981 | Morgan, Jr. | A63C 13/001 36/125 |
| 5,881,477 | A * | 3/1999 | Watson | A63C 13/001 36/122 |
| D880,820 | S * | 4/2020 | Silvester | D2/916 |
| 2006/0096124 | A1 | 5/2006 | Moseley | |
| 2010/0050474 | A1 | 3/2010 | Shittu | |
| 2010/0146820 | A1 | 6/2010 | Ramirez | |
| 2012/0030966 | A1 | 2/2012 | Huynh | |
| 2013/0000153 | A1 | 1/2013 | Weidman et al. | |
| 2017/0181493 | A1 | 6/2017 | Graffeo | |

* cited by examiner

FOOTWEAR SYSTEM

CROSS-REFERENCE TO RELATED APPLICATIONS

This is a United States National application based upon, and claiming the benefit of the Nov. 7, 2017 filing date of PCT application US2017/060267, which in turn claims the benefit under 35 U.S.C. § 119(e) of Provisional Application Ser. No. 62/430,032, filed on Dec. 5, 2016, entitled FOOTWEAR SYSTEM. The entire disclosures of the provisional application and the '267 international application are incorporated by reference herein.

FIELD OF INVENTION

This invention relates generally to a footwear system and more particularly to a footwear system for providing support and stability wearing the system on uneven, soft surfaces such as beaches.

BACKGROUND OF THE INVENTION

Foot wear such as sandals, flip-flops, sneakers and similar shoes commonly are worn on sandy beaches, wet beaches and similar surfaces to protect a wearer's feet. Sandy beaches often are soft, irregular and unstable surfaces; creating difficulty for individuals to walk and/or maintain their balance on them, even when wearing beach shoes. Moreover, sandals, flip-flops and similar structures do not adequately protect the wearer's feet from awkward pivoting that often occurs when an individual is walking on an uneven surface, such as a sand beach, or otherwise protect the wearer's feet from being burnt by hot sand, or becoming coated with sand particles, which can irritate the wearer's feet. In addition, it usually requires undesired energy to walk on an uneven surface, such as a sand beach, with sandals, flip-flops and similar structures.

Sandals designed to be worn on sand, such as on beaches, are disclosed in the prior art, e.g., Reiner et al. U.S. Pat. No. 4,094,081 and Wong U.S. Pat. No. 4,226,031.

The Reiner, et al. '081 patent discloses a beach sandal including a sole 15 which actually forms part of the sandal and is of a solid, nonporous construction. The sole 15 includes downwardly extending peripheral edge 17 that cooperates with surface 19 of the sole to provide an internal recess into which sand can move when a person is wearing the sandal and walking on a beach. In this construction the sole is part of the sandal and extends only a limited distance beyond a user's foot. Moreover, in view of the fact that the sole is a solid member a deep recess needs to be formed in the sole thereby providing a fairly high profile for the wearer of the shoe. This can adversely affect the stability of the wearer of the shoe.

The Wong '031 patent relates to a sandal designed to be worn on soft ground, such as at the beach. Opposite side edges of the sandal slope in a downward outward direction, to provide a wide footprint that allegedly minimizes twisting of a wearer's foot when walking on soft ground, and avoid splashing of water onto the wearer. The bottom surface of the sandal slopes upwardly at the rear and front allegedly to further avoid splashing of water onto the wearer. The construction of the sandal disclosed in the Wong patent includes only solid members and is not believed to provide a desired degree of stability and balance for a wearer of the sandal; particularly when the wearer is walking on soft ground, such as a beach.

Cox U.S. Pat. No. 4,285,082 and Bishop U.S. patent publication 2004/0010943 disclose the use of hook and loop fasteners to removable fasten footwear to surfboards and similar structures to increase traction and prevent a surfer from sliding off of the surfboard. These patent publications do not disclose a beach shoe system employing a removable attachment system between a beach shoe and underlying hover, or stabilizing member to permit an individual employing the system to walk easily on a beach or other soft surface, and permit removal of the beach shoe from the hover member to permit it the beach shoe to be worn by itself, as desired.

SUMMARY OF THE INVENTION

A footwear system includes a pair of shoes commonly worn on sandy beaches and similar surfaces and stabilizing members removably attachable to each of said shoes shoe. The construction of both shoes and the stabilizing members removably attachable thereto are the same. Therefore, this invention will be described with respect to arrangement of one shoe and its respective stabilizing member; it being understood that the other shoe and its respective stabilizing member is the same.

The footwear system of this invention is primarily intended for use for walking on irregular surfaces such as soft sand beaches, wet beaches and the like, although other possible uses are within the scope of this invention.

Reference to the footwear being a "beach shoe" or "beach shoes" is intended to mean flip-flops, sandals, sneakers and similar footwear commonly worn on sandy beaches and the like. Beach shoes do not include ski boots and other footwear designed to be worn specifically on snow and similar cold weather surfaces.

Reference to "beach shoe system" is a system for use on sandy surfaces, beaches and other irregular surfaces, either wet or dry, excluding snow and similar cold weather surfaces, unless specified otherwise. In particular, the beach shoe system of the present invention has its most advantageous use on beaches or other sandy surfaces; wet or dry.

The stabilizing member, when attached to a respective beach shoe, being below and removably attached to the beach shoe. The stabilizing member includes a porous, substantially planar section underlying at least a substantial portion of a bottom surface of the beach shoe and extends transversely beyond peripheral sides of the beach shoe. The stabilizing member supports the beach shoe above ground level and can be viewed as, or considered a hover member for the shoe supported thereon.

In the preferred embodiment the beach shoes are from the group consisting of sandals, flip flops and sneakers; more preferably from the group consisting of sandals and flip flops. However, other types of shoes can be employed in this invention; provided they are suitable for wearing on a beach or similar surface. Specifically excluded from the definition of beach shoes are ski boots and similar constructions to be worn in the snow.

In accordance with this invention cooperating fasteners are provided on a bottom surface of the beach shoe and on an upper, contiguous surface of the porous, substantially planar section of the stabilizing member, respectively, for removably attaching the beach shoe to the stabilizing member.

Most preferably the fasteners on the bottom surface of the beach shoe are secured within recesses of the bottom surface for cooperating with mating fasteners secured to the upper, contiguous surface of the porous, substantially planar section.

Most preferably the one or more fasteners secured within recesses in the bottom surface of the beach shoe and the mating fasteners secured to the upper, contiguous surface of the porous, substantially planar section of the stabilizing member are cooperating hook and loop fasteners. Most preferably the loop fasteners are within the recesses of the bottom surface and the hook fasteners are secured to the upper, contiguous surface of the porous, substantially planar section of the stabilizing member. Most preferably the distal end of the loops, when secured within a complimentary recess in the beach shoe, is recessed below the outer, bottom surface of the beach shoe intended to contact the ground when disengaged from the stabilizing member.

Most preferably the cooperating fasteners include one or more fasteners secured within recesses of a heal and sole region of the bottom surface of the beach shoe for cooperating with mating fasteners secured to the upper, contiguous surface of the porous, substantially planar section.

In the most preferred embodiment of this invention the stabilizing member includes a peripheral rim member attached to the porous, substantially planar section, said peripheral rim member extending downwardly below a lower surface of the porous, substantially planar section and upwardly, slightly above an upper surface of the porous, substantially planar section.

In the most preferred embodiment the peripheral rim extends about the entire periphery of the stabilizing member and the porous, substantially planar section has a degree of flexibility greater than the peripheral rim.

In the most preferred embodiment of this invention the forward end of the sole and the rear end of the heal slightly overlie the peripheral rim of the stabilizing member. This provides a slight rise to the beach shoe and in addition prevents a forward toe region of an individual wearing the beach shoe from hitting or contacting the rim.

The footwear system of this invention enables a wearer thereof to walk on a soft beach or similar surface expending less energy than by wearing solely beach shoes, such as sandals or flip flops; resulting in less chance for an individual wearing of the footwear system of this invention from developing muscle soreness or other injury to the wearer's feet or legs.

Other objects and advantages of this invention will become apparent from the following description of the preferred embodiments of this invention taken in conjunction with the drawings, wherein:

DESCRIPTION OF THE PREFERRED EMBODIMENTS OF THE INVENTION

Figure 1:
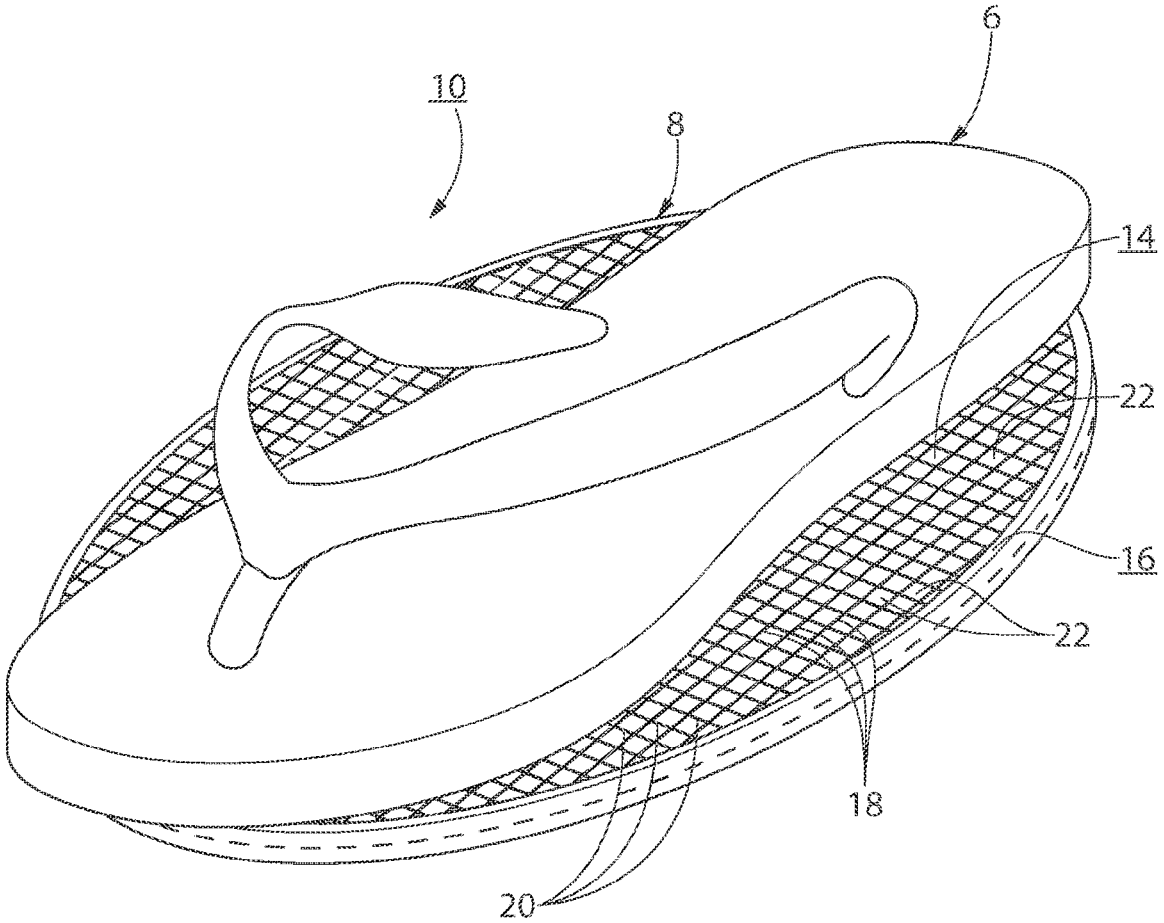
FIG. 1 is an isometric view showing a beach shoe removably connected to a stabilizing member in accordance with this invention; it being understood that the system includes an identical beach shoe removably connected to a similar stabilizing member.

A beach shoe system including a beach shoe 6 and a removable stabilizing member 8 attached thereto in accordance with this invention is illustrated at 10 in FIG. 1; it being understood that a similar beach shoe with removable stabilizing member attached thereto completes the beach shoe system 10 of this invention. For ease of discussion the structural arrangement of one of the beach shoes 6 and removably mounted stabilizing members 8 will be described herein, it being understood that the other beach shoe 6 and stabilizing member 8 are identical in construction.

Figure 2:
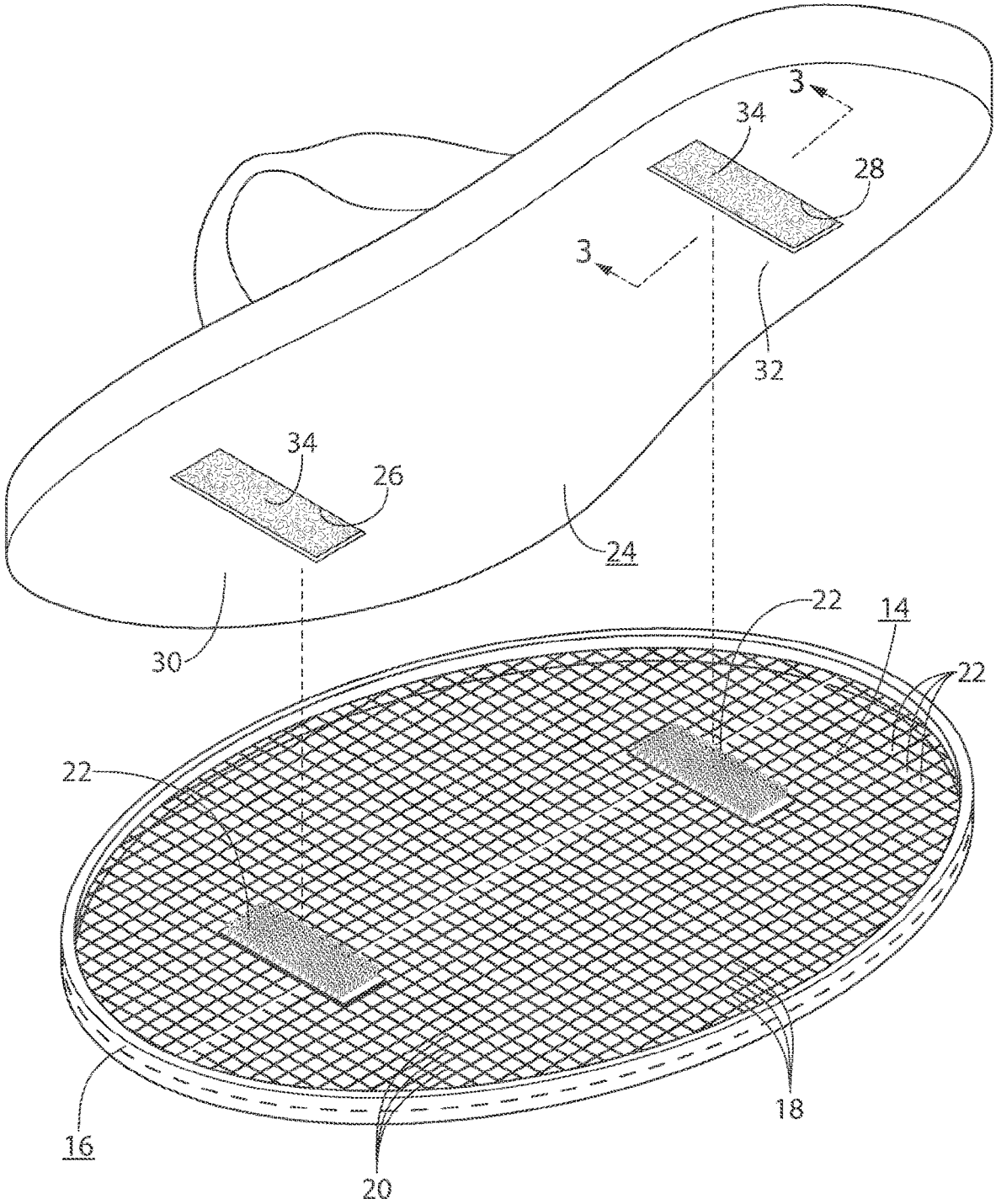
FIG. 2 is an exploded isometric view showing the beach shoe detached from the stabilizing member and inverted to illustrate details of construction of the bottom surface of the beach shoe with fastening means secured within recesses thereof.

Referring to FIGS. 1 and 2, stabilizing member 8 includes a porous central section 14 and a peripheral rim 16 extending continuously about the central section. Although the shape of the stabilizing member may be varied the most preferred configuration is oval, or oblong; most preferably the same or similar to the shape of a badminton racket. It is important that the shape permit the wearer to walk in a normal gate without the sides of the stabilizing member hitting each other and possibly causing the wearer to fall and be injured.

Referring to FIG. 1, the stabilizing member 8 provides its stabilizing function by extending transversely beyond the sides of the beach shoe 6. In the most preferred embodiment, the dimension of the stabilizing member 8 in the length-wise direction of the beach shoe 6 is less than the length of the beach shoe to permit the forward and rearward ends of the beach shoe to extend over the peripheral rim 16 of the stabilizing member 8 when the beach shoe is removably attached to the stabilizing member. Although less preferred, it is within the scope of this invention to dimension the stabilizing member 8 so that it has a length substantially equal to or slightly larger than the length of the beach shoe. However, if the frontal end of the stabilizing member 8 extend too far beyond the front of the beach shoe it would be difficult for an individual wearing the beach shoe system 10 to walk with a normal gate on a sandy or other irregular surface. Or for that matter on any surface while wearing the beach shoe assembly. Preferably the distal end of the stabilizing member 8 aligned with the front end of the beach shoe should not extend more than 1 inch beyond the aligned front end of the beach shoe; more preferably less than ½ inch beyond the aligned front end of the beach shoe, and most preferably the rim 16 should underlie the aligned front end of the beach shoe. This most preferred arrangement prevents a wear's toes from hitting the rim 16 and being injured; especially when the beach shoe is open at the front end, such as a sandal or flip-flop.

Although somewhat less important it also is desirable that the rear end of the stabilizing member 8 not extend too far behind the aligned rear end of the beach shoe 6. Most preferably the rear end of the beach shoe 6 also should slightly overlie the rim 16 at the rear end of the stabilizing member to prevent the rear surface of an individual wearing the beach shoe from hitting his/her heal on the rim 16. However, it is believed to be less important for the rear end of the beach shoe to overlie the rim 16 than for the front end of the beach.

It may be desirable to sell different size beach shoe systems to accommodate individuals having different size feet. However, it is believed that no more than 3 or 4 different size systems might be needed; and possibly even less.

Referring to FIGS. 1 and 2, the porous central section 14 includes a plurality of filaments or strands 18 extending in a first direction and spaced apart from each other and a plurality of filaments or strands 20 crossing the plurality of filaments or strands 18 and generally perpendicular to said first direction and spaced apart from each other. The filaments or strands 18 and 20 are secured to the peripheral rim 16 in the same or similar manner to the attachment of filaments to the rim of tennis rackets and badminton rackets. For simplicity of presentation the specific method of attaching the filaments 18, 20 to the rim 16 is not illustrated since the attachment means is a well known expedient to individuals skilled in the art.

The crossing filaments and strands 18, 20 define passages 22 that are substantially square in plan view. In the most preferred embodiment of this invention the filaments or strands 18, 20 are approximately 1/16 inch in diameter and are spaced apart from each other a distance to provide essentially three (3) passages per inch in the mutually perpendicular directions of the strands 18, 20.

In accordance with the broadest aspects of this invention the diameter of the filaments 18 and 20 can be varied, as well as their orientation and spacing relative to each other to provide passages of varying geometric shapes and dimensions. However, in the most preferred embodiment the strands 18 are mutually perpendicular to the strands 20 and the number of complete passages per inch in each of the mutually perpendicular directions of the strands 18, 20 is between 2 and 4.

In accordance with this invention the filaments 18 and 20 can be made from a variety of materials, including various polymers and plastic coated metal strands; the same or similar to filaments employed to manufacture rackets for tennis and badminton. The specific material of the filaments does not constitute a limitation on the broadest aspects of this invention. Any material can be employed which is strong enough to support an individual without breaking, and which does not pose any safety hazard to an individual wearing the footwear system.

In accordance with this invention the porous central section 14 has some give or flexibility providing a beneficial feature of this invention, as described in detail hereinafter.

Most preferably the flexibility or resilience of the porous central section 14 is greater than that of the peripheral rim 16; the peripheral rim providing excellent tension on the filaments 18 and 20 forming the porous central section.

Figure 4:
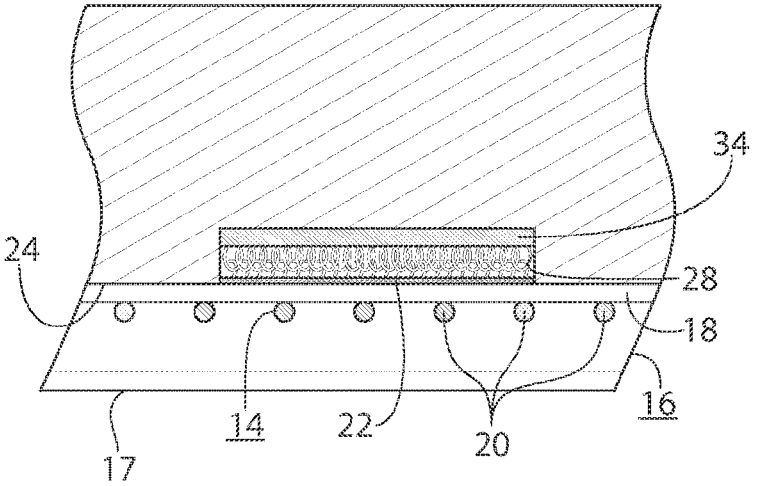
FIG. 4 is a sectional view similar to FIG. 3 but with the beach shoe attached to the stabilizing member.

Referring to FIGS. 2 and 4, fastener members 22 are permanently secured to the upper surface of the porous central section 14. Most preferably the fastener members 22 are part of a hook and loop fastener system of the type sold under the trademark Velcro. Most preferably the fastener members 22 include the hooks of the fastener system and are secured to the upper surface by an industrial strength adhesive or similar bonding material.

Referring to FIGS. 1-4, the beach shoe 6 of the beach shoe system includes a bottom surface 24 having recesses 26, 28 in sole and heal regions 30, 32 thereof for receiving complementary shaped fastener members 34 therein for cooperating with aligned fastener members 22 when the shoe 6 is properly positioned to be removably secured to the porous central section 14 of the stabilizing member 8. The complimentary fastener members 34 preferably include the loops for cooperating with hooks preferably included on the fastener members 22. In the most preferred embodiments the fasteners are secured within recess 26, 28 by an adhesive; preferably an industrial adhesive, and the upper surface of the fastener members is positioned below the upper edges of the recesses 26, 28 to be protected when an individual is wearing the beach shoes 6 without the stabilizing member 8. In an exemplary, non-limiting embodiment of this invention, the recesses 26, 28 have a depth of approximately 1/8 inch and the thickness of the fastener members 24 is approximately 1/16 inch or just slightly greater.

In the illustrated embodiments the fastener members 34 are essentially rectangular and are disposed within substantially rectangular recesses 26, 28. Preferably the fastener members 34 are adhesively secured to a lower surface of the rectangular recesses 26, 28 by an industrial strength adhesive or similar bonding material. However, the particular shape and dimensions of the fastener members 34 can be varied in accordance with the broadest aspects of this invention. Most preferably the recesses in the sole and heal regions of the shoes for receiving the fastener members will have a complimentary shape to that of the fastening members.

Figure 3:
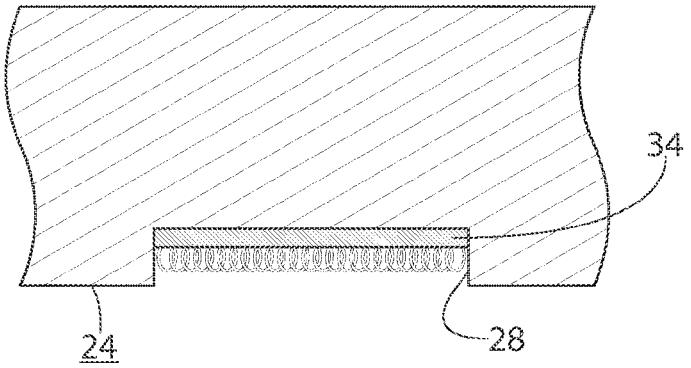
FIG. 3 is a sectional view taken along line 3-3 of FIG. 2.

As can be seen best in FIGS. 3 and 4, the distal ends of the loops of the fastener members 34 are positioned slightly below the exposed bottom surface 24 of the shoe 6. Therefore, when an individual is wearing shoes 6 without the stabilizing member 8, such as when an individual is walking on a boardwalk, sidewalk or road leading to or away from a beach area, the loops of the fastener members 34 will essentially be protected by being disposed below the exposed bottom surface 24 that engages the ground.

It is important that the peel strength between the fastener member 22 and the upper surface of the porous central section 14 of stabilizing member 8 be substantially greater than the peel strength between the fastener member 34 and the fastener member 22. This is required to permit the fastener members 34 and 22 to be separated from each other without pulling the fastener member 22 off of the porous central section 14.

Similarly, it is important that the peel strength between the fastener members 34 and the bases of the recesses 26, 28 to which they are adhesively secured be substantially greater than the peel strength between the fastener members 34 and the cooperating fastener members 22. This is required to permit the fastener members 34 and 22 to be separated from each other when desired without pulling the fastener members 34 out of their attached engagement with the bottom walls of the recesses 26, 28.

As noted previously, the porous central section 14 of the stabilizing member 8 has some give or flexibility, and preferably has greater flexibility that the peripheral supporting rim 16. As can be seen in FIG. 4, the lower distal end 17 of the peripheral rim 16 extends below the lower distal surface of the porous central section 14. When an individual is wearing the beach shoe system of this invention on a wet beach surface the distal end 17 of the rim 16 will provide the most pronounced engagement with the wet beach surface and in many cases will provide the sole contact with the beach surface. This minimal peripheral contact of the stabilizing member 8 with the wet surface makes it relatively easy for an individual wearing the system 10 to walk along the surface.

When an individual wearing the system 10 is walking on un-compacted, hot sand, portions of the sand underling the porous central section 14 of the stabilizing member 8 can move or pass through the pores, as compared to a solid surface which would compact underlying sand and provide a possibly unstable surface for the individual wearing the system. Moreover, by dimensioning the system so that the forward and rearward regions of the beach shoe 6 overlies the rim 16 of the stabilizing member 8, the forward and rearward region of the beach shoe is slightly raised above ground level to minimize possible engagement of the surface with the wearer's foot.

The foregoing disclosure is the best mode devised by the inventors for practicing this invention. It is apparent, however, that beach shoe systems incorporating modifications and variations will be obvious to one skilled in the art. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What we claim as our invention is the following:

1. A beach shoe system including a beach shoe and a stabilizing member, said stabilizing member, when attached to said beach shoe, being below said beach shoe and being removably attached to said beach shoe, said stabilizing member including a porous, substantially planar section having an upper surface underlying at least a substantial portion of a bottom surface of said beach shoe, and an opposed lower surface, said porous, substantially planar section of said stabilizing member extending transversely beyond peripheral sides of said beach shoe and including a peripheral rim member attached to said porous substantially planar section, said peripheral rim member extending downwardly below the lower surface of the porous, substantially planar section and upwardly above the upper surface of said stabilizing member, a forward end of said beach shoe overlying said peripheral rim.

2. The beach shoe system of claim 1, wherein said beach shoe is in the group consisting of sandals and flip-flops.

3. The beach shoe system of claim 1, wherein cooperating fasteners are provided on a bottom surface of said beach shoe and on the upper surface of said porous, substantially planar section of said stabilizing member, respectively, for removably attaching said beach shoe to said stabilizing member.

4. The beach shoe system of claim 1, wherein cooperating fasteners are provided on a bottom surface of said beach shoe and the upper surface of said porous, substantially planar section of said stabilizing member, respectively, for removably attaching said beach shoe to said stabilizing member, said cooperating fastener's including one or more fasteners secured within recesses of said bottom surface of said beach shoe for cooperating with mating fasteners secured to said upper surface of said porous, substantially planar section.

5. The beach shoe of claim 1, wherein cooperating fasteners are provided on a bottom surface of said beach shoe and the upper surface of said porous, substantially planar section of said stabilizing member, respectively, for removably attaching said beach shoe to said stabilizing member, said cooperating fastener's including one or more fasteners secured within recesses of said bottom surface of said beach shoe for cooperating with mating fasteners secured to said upper surface of said porous, substantially planar section, said one or more fasteners secured within the recesses of said bottom surface of said beach shoe and the mating fasteners being cooperating hook and loop fasteners.

6. The beach shoe of claim 1, wherein cooperating fasteners are provided on a bottom surface of said beach shoe and the upper surface of said porous, substantially planar section of said stabilizing member, respectively, for removably attaching said beach shoe to said stabilizing member, said cooperating fastener's including one or more fasteners secured within recesses of said bottom surface of said beach shoe for cooperating with mating fasteners secured to said upper surface of said porous, substantially planar section, said one or more fasteners secured within the recesses of said bottom surface of said beach shoe being loop fasteners and the mating fasteners being cooperating book fasteners.

7. The beach shoe system of claim 1, wherein cooperating fasteners are provided on a bottom surface of said beach shoe and the upper surface of said porous, substantially planar section of said stabilizing member, respectively, for removably attaching said beach shoe to said stabilizing member, said cooperating fastener's including one or more fasteners secured within recesses of a heal and sole region of said bottom surface of said beach shoe for cooperating with mating fasteners secured to said upper surface of said porous, substantially planar section.

8. The beach shoe system of claim 1, wherein a rear end of said beach shoe overlies said peripheral rim.

9. The beach shoe system of claim 1, wherein said forward end of said beach shoe overlying said peripheral rim is substantially coterminous with said peripheral rim.

10. The beach shoe system of claim 1, wherein said porous substantially planar section includes from between 2-4 passages per inch in each of two mutually perpendicular directions.

11. The beach shoe system of claim 1, wherein said porous substantially planar section includes three passages per inch in each of two mutually perpendicular directions.

12. The beach shoe system of claim 1, wherein said stabilizing member is substantially oblong, said oblong having a long dimension and a short dimension substantially normal to said long dimension said beach shoe having a length in the same direction as said long dimension of said oblong when said beach shoe is removably attached to said support member.

13. The beach shoe system of claim 1, wherein said stabilizing member is in the shape of a badminton head having a substantially long dimension and a short dimension substantially normal to said long dimension said beach shoe having a length in the same direction as said long dimension of said badminton head when said beach shoe is removably attached to said support member.

* * * * *